United States Patent [19]

Betsudan et al.

[11] Patent Number: 4,559,540

[45] Date of Patent: Dec. 17, 1985

[54] ANTENNA SYSTEM WITH PLURAL HORN FEEDS

[75] Inventors: Shinichi Betsudan; Katsuhiko Aoki; Shigeru Sato, all of Hyogo; Takashi Katagi, Kanagawa, all of Japan

[73] Assignee: Mitsubishi Denki Kabushiki Kaisha, Tokyo, Japan

[21] Appl. No.: 744,898

[22] Filed: Jun. 17, 1985

Related U.S. Application Data

[60] Continuation of Ser. No. 583,509, Feb. 24, 1984, abandoned, which is a division of Ser. No. 296,024, Aug. 25, 1981, Pat. No. 4,462,034.

[30] Foreign Application Priority Data

Aug. 28, 1980 [JP] Japan ..... 55-119988

[51] Int. Cl.[4] ..... H01Q 19/14

[52] U.S. Cl. ..... 343/761; 343/781 CA

[58] Field of Search ..... 343/761, 781 P, 781 CA, 343/839

[56] References Cited

U.S. PATENT DOCUMENTS

| | | | |
|---|---|---|---|
| 1,932,469 | 10/1933 | Leib et al. | 343/839 |
| 3,680,141 | 7/1972 | Karikomi | 343/761 |
| 4,062,018 | 12/1977 | Yokoi | 343/781 CA |
| 4,186,402 | 1/1980 | Mizusawa et al. | 343/781 CA |
| 4,260,993 | 4/1981 | Aubry et al. | 343/781 CA |

*Primary Examiner*—Eli Lieberman

*Attorney, Agent, or Firm*—Sughrue, Mion, Zinn, Macpeak & Seas

[57] ABSTRACT

An antenna system having a main reflector, a sub-reflector, and a plurality of horns for radiating different frequencies includes a beam waveguide system which cancels cross polarization otherwise inherent in the system. If the antenna system uses a non-rotationally-symmetric sub-reflector the cross polarization caused thereby is cancelled by the beam waveguide system having at least two focusing reflectors and selected parameters. Alternatively the beam waveguide system can be used with a rotationally symmetric and stationary sub-reflector by being positioned to reflect said beam on the axis of the main reflector. Either the horns or the focusing reflectors may be rotatably switched, the other group being stationary.

3 Claims, 6 Drawing Figures

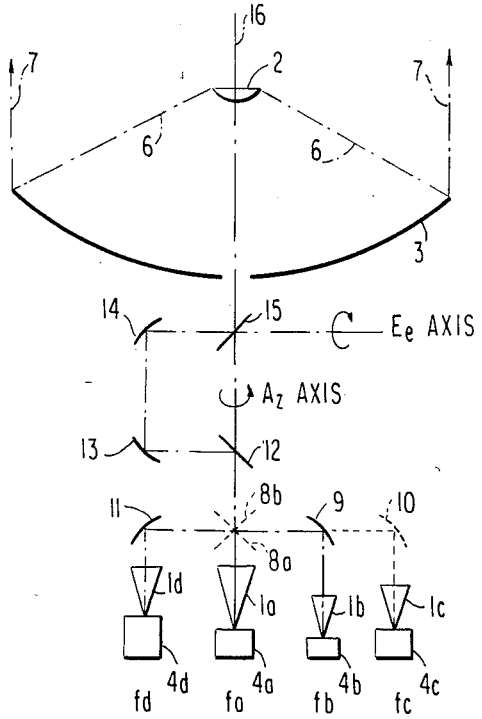
FIG. 1
PRIOR ART
FIG. 6
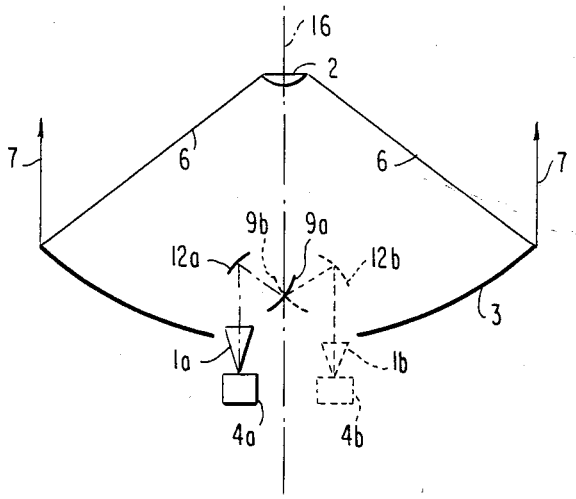

ANTENNA SYSTEM WITH PLURAL HORN FEEDS

This is a continuation, of application Ser. No. 583,509, filed Feb. 24, 1984, now abandoned, which is a divisional of application Ser. No. 296,024 filed Aug. 25, 1981, now U.S. Pat. No. 4,462,034.

BACKGROUND OF THE INVENTION

This invention relates to a large antenna system for transmitting and receiving radio waves in a plurality of frequency bands, in which the primary radiators are switched to transmit and receive such radio waves.

Conventional antenna systems employed as satellite communication antennas or large radio telescopes are as shown in FIGS. 1 and 2.

FIG. 1 shows an antenna system in which a beam waveguide system is employed as a primary radiation system and a plurality of horns for many frequency bands are provided. In FIG. 1, reference characters 1*a*, 1*b*, 1*c* and 1*d* designate horns for radiating radio waves having frequency bands fa, fb, fc and fd, respectively; 2, a sub-reflector; 3, a main reflector; 4*a*, 4*b*, 4*c* and 4*d*, feeding units provided for the frequency bands, respectively; 6 and 7, radiated beams provided by reflecting the radio wave from sub-reflector 2 and main reflector 3; 8 (indicated as 8*a* or 8*b*), 9, 10, 11, 12, 13, 14 and 15, focusing reflectors which are curved mirrors or plane mirrors as shown; and 16, the axis of the main reflector 3.

In the case of frequency band fa, the focusing reflector 8 is retracted so that the radio wave from horn 1*a* is directed to the focusing reflector 12. The radio wave reflected from the focusing reflector 12 is directed to the focusing reflector 13, where it is reflected. The radio wave thus reflected is further reflected by the focusing reflectors 14 and 15, the sub-reflector 2 and the main reflector 3, and is finally radiated in the form of beam 7. A received radio wave is transmitted to the horn 1*a*, retracing the above-described path.

In the case of frequency band fb, the focusing reflector 8 is set as indicated at 8*a*, so that the radio wave from the horn 1*b* is directed to the focusing reflector 12 after being reflected by the focusing reflector 9 and 8*a*. Then, similarly as in the case of the frequency fa the radio wave is reflected by the sub-reflector 2 and the main reflector 3 and is finally radiated in the form of a beam 7 from the main reflector 3.

In the case of the frequency band fc, the focusing reflector 8 is set as indicated at 8*a*, and the focusing reflector 9 is retracted, so that the radio wave of the frequency band fc from the horn 1*c* is directed to the focusing reflector 10, thus reaching the main reflector 3 through the same path as that in the case of the frequency band fb. Finally, the radio wave is radiated in the form of a beam 7 from the main reflector 3.

In the case of the frequency band fd, the focusing reflector 8 is set as indicated at 8*b*. The radio wave of the frequency band fd from the horn 1*d* is directed to the focusing reflector 11, where it is reflected towards the focusing reflector 8*b*. Then, the radio wave reaches the main reflector 3 through the same path as that in the case of the frequency band fb or fc, and is finally radiated in the form of a beam 7 from the main reflector 3.

In the above-described antenna system, while the antenna rotates around an elevation angle axis $E_e$, the horns 1*a* through 1*d* and the feeding units 4*a* through 4*d* are stationary. As a result inspection and maintenance are facilitated. However, the antenna system has certain disadvantages. Since a plurality of focusing reflectors are arranged in association with mechanical means for controlling azimuth and elevation angles, the antenna system is intricate and bulky.

In another type of conventional antenna system, as shown in FIG. 2, a beam waveguide system is not used. Instead, different primary radiators (or horns) are selected for different frequency bands.

In FIG. 2, reference characters 1*a* and 1*b* designate horns; 2*a* or 2*b*, a sub-reflectors; 3, a main reflector; 4*a* and 4*b*, feeding units; 5*a*, 5*b*, 6*a*, 6*b* and 7, the paths of radio waves radiated by the horns 1*a* and 1*b*; 16, the axis of the main reflector 3; and 17, the axis of the horn.

In the case of frequency band fa, the sub-reflector is turned towards horn 1*a* as indicated at 2*a*. Therefore, the radio wave from horn 1*a* is reflected by the sub-reflector (2*a*) and the main reflector 3, i.e., it is radiated through the path 5*a*, 6*a* and 7. A received radio wave reaches the horn 1*a* retracing the above-described path.

In the case of frequency band fb, the sub-reflector is set as indicated at 2*b* so as to face the horn 1*b*.

In the above-described antenna system, the horn axis 17 is offset from the axis 16 of the main reflector 3. That is, the antenna system is a so-called offset type antenna system. The sub-reflector is in the form of a non-rotationally-symmetric (not axially symmetric) mirror surface (even if the main reflector is of an axially symmetric mirror surface). Therefore, a cross polarization is produced by the non-rotationally-symmetric mirror surface. Accordingly, in the use of a circularly polarized wave, the beams of the clockwise and counterclockwise polarized waves which are orthogonal with each other are tilted in the opposite directions, as a result of which so-called "beam separation" is caused. This lowers the accuracy in directivity of the antenna and the gain; that is it degrades the characteristics of the antenna. Furthermore, in the use of a linearly polarized wave, the cross polarization characteristic of the antenna is lowered.

SUMMARY OF THE INVENTION

In view of the foregoing, an object of this invention is to provide a relatively small antenna system in which the cross polarization attributed to the offset type antenna system is cancelled, and the primary radiators are switched for transmitting and receiving radio waves in a plurality of frequency bands.

These and other object of the invention are obtained by the invention, wherein in an antenna system used for a plurality of frequency bands by switching the primary radiators, the cross polarization caused by the use of the non-rotationally-symmetric auxiliary reflector with the horn's axis set off is cancelled by the beam waveguide system. The latter comprises at least two focusing reflectors. Beam separation in the use of a circularly polarized wave is suppressed, thereby maintaining a high degree of accuracy in directivity of the antenna and preventing a reduction in gain of the antenna. In addition, for the same reason, the cross polarization characteristic of the antenna in the use of a linearly polarized wave can be improved.

In the case where a rotationally symmetric auxiliary reflector is employed in the antenna system, the beam waveguide systems each comprise at least two focusing reflectors and meet the conditions for cancelling the cross polarization. Therefore, the antenna system according to the invention is relatively simple in arrangement and small in size.

BRIEF DESCRIPTION OF THE DRAWINGS

FIG. 1 is an explanatory diagram showing a conventional focused beam type antenna system.

FIG. 6 is an explanatory diagram showing a further example of the antenna system according to the invention.

DETAILED DESCRIPTION OF THE INVENTION

Figure 3:
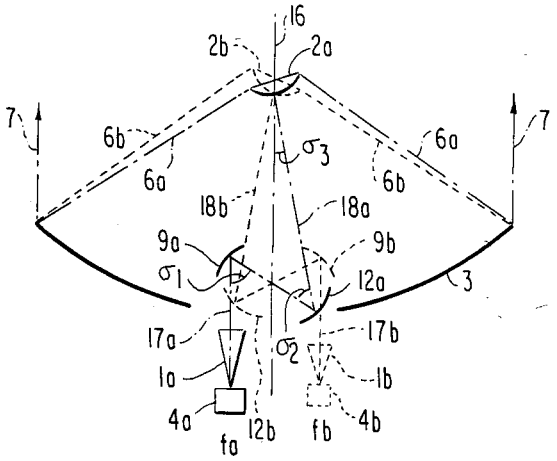
FIG. 3 is an explanatory diagram showing one example of an antenna system according to the invention.

One example of an antenna system according to this invention will be described with reference to FIG. 3. The antenna system is used for two frequencies. In FIG. 3, reference characters 1*a* and 1*b* designate primary radiators (or horns); 2 (indicated as 2*a* or 2*b*), a sub-reflector; 3, a main reflector; 4*a* and 4*b*, feeding units; 6*a*, 6*b* and 7, the paths of radio waves radiated by the horns 1*a* and 1*b*; 9*a*, 9*b*, 12*a* and 12*b*, focusing reflectors; 16, axis of the main reflector; and 18*a* and 18*b*, the central axes of beams.

If, in FIG. 3, angles between radio waves incident to focusing reflectors 9*a* and 12*a* and the sub-reflector set at 2*a* and those reflected thereby are represented by $\sigma_1$, $\sigma_2$ and $\sigma_3$, the beam radii of these reflectors are represented by $\omega_1$, $\omega_2$ and $\omega_3$, and the focal distances of these reflectors are $f_1$, $f_2$ and $f_3$, respectively, then a cross polarization level C provided by this non-rotationally-symmetric mirror system can be represented by the following expression:

$$C = \frac{1}{2e}\left\{ \frac{\omega_1}{f_1}\tan\frac{\sigma_1}{2} + \frac{\omega_2}{f_2}\tan\frac{\sigma_2}{2} + \frac{\omega_3}{f_3}\tan\frac{\sigma_3}{2} \right\} \quad (1)$$

where $$\omega_i = \frac{D_i}{2}\cdot\frac{\sqrt{8.69}}{L} \quad i = 1,2,3 \quad (2)$$

$$\frac{1}{f_i} = \frac{1}{R_i} - \frac{1}{R_i'}$$

in which $D_i$ is the diameter of each reflector (for instance, $D_1$, $D_2$ and $D_3$ being the diameters of the sub-reflector, the focusing reflector 9*a* and the focusing reflector 12*a*, respectively)

L is the edge level of each reflector, $R_i$ is the curvature of a radio wave front incident to each reflector, $R_i'$ is the curvature of a radio wave front reflected by each reflector, and e=2.71828.

Figure 2:
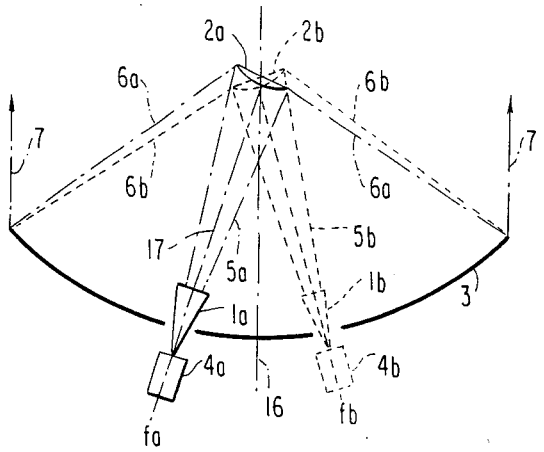
FIG. 2 PRIOR ART
FIG. 2 is an explanatory diagram showing a conventional horn switching type antenna switch.

If $D_i$, $f_i$, $\omega_i$ and $\sigma_1$ are suitably selected with the frequency fa, then the mirror system can be converted into one in which C=0, i.e., no cross polarization components are produced. This means that the cross polarization attributed to the offset type antenna system shown in FIG. 2 is cancelled out by that which is produced by the beam wave-guide system (which is the combination of the horn (1) and the focusing reflectors (9 and 12) in this example).

In the mirror system in which, with the frequency fa, data $f_1$, $f_2$, $f_3$, $\sigma_1$, $\sigma_2$ and $\sigma_3$ are defined to have C=0, it is possible that, with the frequency fb, C=0 or C≈0 can be obtained by changing the dimensions of the horn.

The mirror system thus defined for the frequency fa is constituted by the horn 1*a*, focusing reflectors 9*a* and 12*a*, sub-reflectors 2*a* and main reflector 3. The focusing reflectors 9*a* and 12*a*, the sub-reflector 2*a* and the main reflector 3 are commonly employed in the mirror system for the frequency fb. Therefore, if the horn for radiating the frequency fb is set on the circumference which is scribed by the axis 17*a* of the horn 1*a* where the axis 17*a* is turned around the axis 16 of the main reflector 3 (in the example shown in FIG. 3, the horns 1*a* and 1*b* being positioned symmetrical with each other) and the focusing reflectors 9*a* and 12*a* and sub-reflector 2*a* are set at 9*b*, 12*b* and 2*b* by turning them through 180° about the axis 16, then the mirror system for the frequency fb will be as indicated by the broken lines.

In the above-described system, the horns are set stationary, and the reflectors 9*a*, 12*a* and 2*a* are turned; however, it is obvious that the system may be so modified that the reflectors are set stationary, and the horns are turned about the axis 16.

Figure 4:
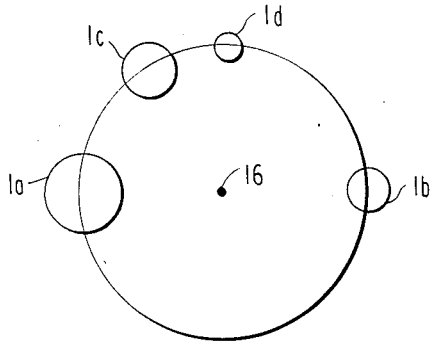
FIG. 4 is an explanatory diagram showing another example of the antenna system according to the invention.

FIG. 4 shows one example of the arrangement of horns for four frequencies. Four horns 1*a*, 1*b*, 1*c* and 1*d* are arranged so that the antenna system can be used for four frequency bands. In the example, four horns are provided; however, the invention is not limited thereto. That is, more than four horns may be arranged if they are set mechanically correctly.

Figure 5:
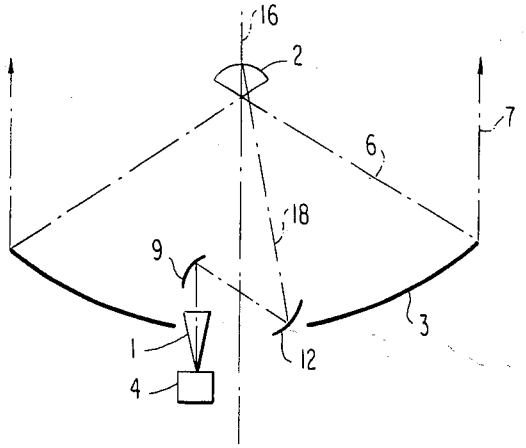
FIG. 5 is an explanatory diagram showing one example of a Gregorian antenna to which the technical concept of the invention is applied.

FIG. 5 shows one example of a Gregorian antenna to which the technical concept of the invention is applied. Similarly as in the above-described examples, a plurality of horns and a plurality of feeding units are provided (although only one horn 1 and one feeding unit 4 are shown).

In one particular example of the antenna system of the invention as shown in FIG. 6 in which the $\sigma_3$ is equal to zero, the axis 16 of the main reflector coincides with the beam reflected by the focusing reflector 9*a*. In this case, the sub-reflector 2 is set stationary, and only the focusing reflectors 9*a* and 12*a* are turned about the axis 16 so as to be set at 9*b* and 12*b*, respectively.

The same effect is obtained by turning the horn 1*b* about the axis 16 with the focusing reflectors 9*a* and 12*a*, similarly as in the above-described case. In this case, the condition for cancelling the cross polarization is met only by the beam waveguide system which is the primary radiator.

What is claimed:

1. In an antenna system of the type which is used for a plurality of frequency bands, said antenna system comprising a main reflector (3) having an axis of symmetry, a subreflector (2) rotationally symmetric with respect to said axis, a group of horns (1*a*, 1*b*) used for plural frequency bands, and at least two focusing reflectors (9*a*, 12*a*, 9*b* and 12*b*) for eliminating cross-polarization produced by one of said horns and said subreflector, said horns being arranged on the circumference of a circle having a center on said axis of symmetry with one of said focusing reflectors being arranged on said axis of symmetry, to thereby constitute a beam waveguide system for the plural bands.

2. The antenna system as claimed in claim 1, wherein said focusing reflectors are fixed and said horns are rotated around said axis of symmetry whereby a selected one of said horns is directed toward said focusing reflectors to switch the frequency bands.

3. The antenna system as defined in claim 1, wherein said horns are fixed and said focusing reflectors are rotatable around said axis of symmetry whereby said focusing reflectors are directed toward a selected one of said horns to switch the frequency bands.

* * * * *